US008161990B1

(12) United States Patent
Coletta et al.

(10) Patent No.: US 8,161,990 B1
(45) Date of Patent: Apr. 24, 2012

(54) CLOTHESLINE COVER APPARATUS

(76) Inventors: Anthony J. Coletta, Essendon (AU); Jayden Paul Coletta, Essendon (AU)

( * ) Notice: Subject to any disclaimer, the term of this patent is extended or adjusted under 35 U.S.C. 154(b) by 85 days.

(21) Appl. No.: 12/828,564

(22) Filed: Jul. 1, 2010

(51) Int. Cl.
*E04H 15/08* (2006.01)
*E04F 10/00* (2006.01)

(52) U.S. Cl. ..... 135/88.12; 135/117; 135/96; 160/22; 160/71

(58) Field of Classification Search ..... 135/88.07, 135/88.1, 88.11, 88.12, 96, 117; 160/5, 7, 160/22, 61–62, 71, 80; 211/168, 119.18
See application file for complete search history.

(56) References Cited

U.S. PATENT DOCUMENTS 1,796,564 A * 3/1931 Firguson ..... 160/62
2,967,567 A * 1/1961 Heckerman ..... 160/62
3,096,884 A 7/1963 Leshner
3,503,566 A * 3/1970 Travis ..... 242/394
3,918,510 A * 11/1975 Hayward ..... 160/45
3,923,074 A * 12/1975 McKee ..... 160/22
4,171,013 A * 10/1979 Clark ..... 160/22
4,754,774 A * 7/1988 Leader ..... 135/88.14
5,016,762 A 5/1991 Tsabar
5,407,007 A * 4/1995 Lowrey ..... 160/22
5,591,907 A 1/1997 Stein et al.
6,484,069 B2 * 11/2002 Osinga ..... 700/275
6,782,936 B1 * 8/2004 Girard et al. ..... 160/66
7,000,788 B2 2/2006 Wüster
D532,117 S 11/2006 Bruni
7,152,652 B2 * 12/2006 Heitel ..... 160/5
2007/0240832 A1 * 10/2007 Cavarec ..... 160/70

* cited by examiner

*Primary Examiner* — Winnie Yip

(57) ABSTRACT

A clothesline cover apparatus for protecting a clothesline from the rain comprising a housing, a water-resistant housing extendable from the housing via a first telescopic pole and a second telescopic pole, and a first sensor for detecting the presence of or absence of rain. When the first sensor detects rain, a microprocessor activates a motor to extend the first and second telescopic poles out of the housing to extend the canvas over the clothesline. When the first sensor detects the absence of rain, the microprocessor activates the motor to retract the telescopic poles.

4 Claims, 5 Drawing Sheets

CLOTHESLINE COVER APPARATUS

FIELD OF THE INVENTION

The present invention is directed to a clothesline cover for covering clotheslines in the event of rain. More particularly, the present invention is directed to a clothesline cover that can expand to cover the clothesline in the event of rain and retract into a housing the absence of rain.

BACKGROUND OF THE INVENTION

Many individuals dry their clothes on clotheslines outside of their homes. In the event of rain, the clothes must be taken off the clothesline. The present invention features a clothesline cover apparatus that can cover a clothesline in the event of rain. The apparatus can detect rain and cause telescopic poles to extend a water-resistant canvas over the clothesline.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
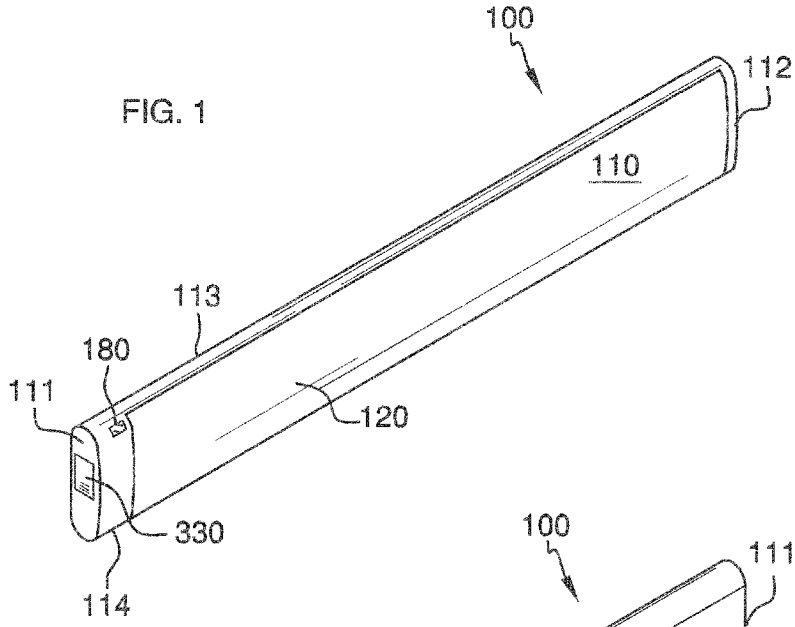
FIG. 1 is a perspective view of the clothesline cover apparatus of the present invention in a stored position.
Figure 2:
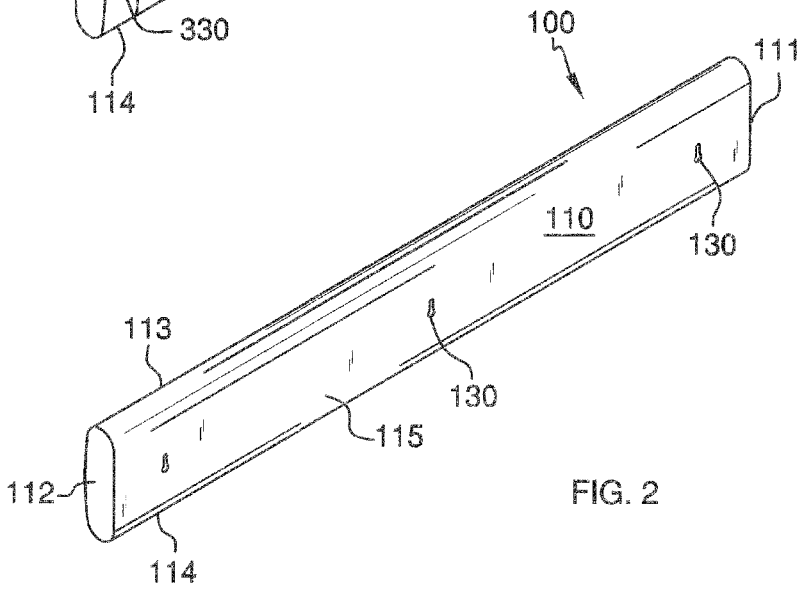
FIG. 2 is a rear perspective view of the clothesline cover apparatus of the present invention in a stored position.
Figure 3:
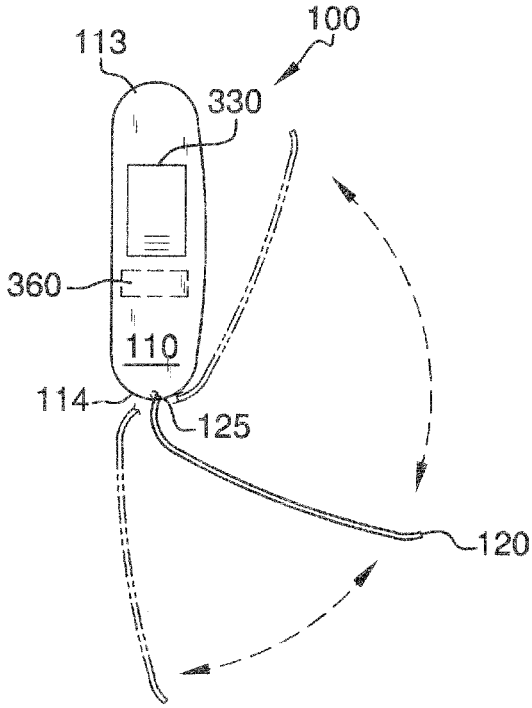
FIG. 3 is a side view of the clothesline cover apparatus of the present invention in a stored position.

Referring now to FIGS. 1-7, the present invention features a clothesline cover apparatus 100. The clothesline cover apparatus 100 is for covering a clothesline to protect clothes on the clothesline from rain.

The clothesline cover apparatus 100 comprises a housing 110 that temporarily houses a water-resistant canvas 210. The housing 110 has a first side 111, a second side 112, a top 113, a bottom 114, a front, a back surface 115, and an inner cavity. A door 120 is pivotally attached in the front of the housing 110 via a hinge 125. The door 120 can move between multiple positions including an open position and a closed position (see FIG. 3) via the hinge 125.

The housing 110 can be attached to a wall or other similar surface via an attachment means. For example, in some embodiments, a plurality of mounting holes 130 is disposed on the back surface 115 of the housing 110 for allowing the housing 110 to be attached to a wall (see FIG. 2). The attachment means is not limited to the aforementioned mounting holes 130.

Folded in the inner cavity of the housing 110 (e.g., when not in use) is a water-resistant canvas 210. The canvas 210 has a top surface, a bottom surface, a first side edge 211, a second side edge 212, a front edge 213, and a back edge. The canvas 210 can be expanded from the housing 110 so as to cover a clothesline.

Figure 6:
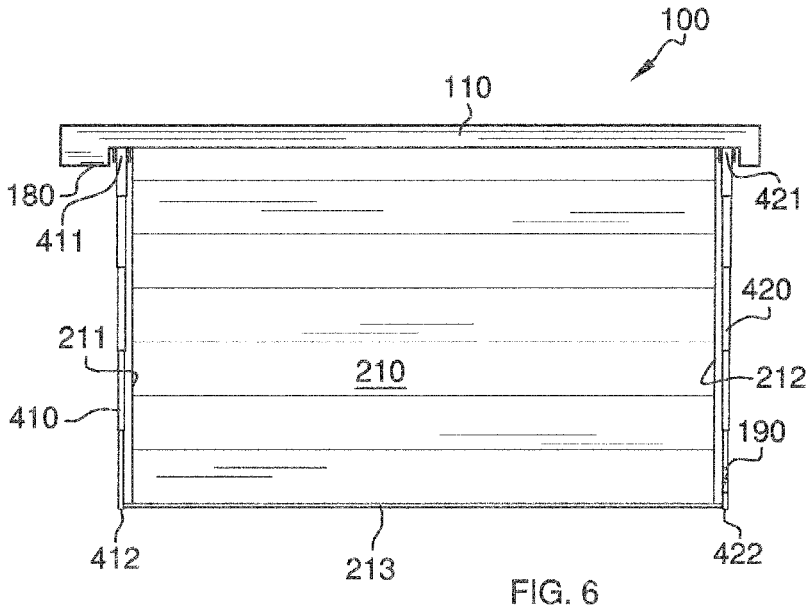
FIG. 6 is a top view of the clothesline cover apparatus of the present invention in an extended position.
Figure 7:
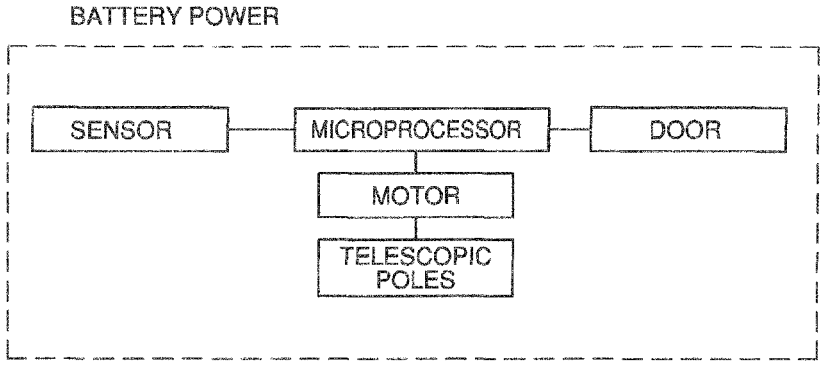
FIG. 7 is a schematic representation of the electrical components of the clothesline cover apparatus of the present invention.

In some embodiments, the first side 211 of the canvas 210 is attached to a first telescopic pole 410 having a first end 411 and a second end 412, for example the second end 412 of the first telescopic pole 410 is attached to the first side 211 of the canvas 210 near the front edge 213 (see FIG. 6). In some embodiments, the second side 212 of the canvas 210 is attached to a second telescopic pole 420 having a first end 421 and a second end 422, for example the second end 422 of the second telescopic pole 420 is attached to the second side 212 of the canvas 210 at the front edge 213. The first telescopic pole 410 and second telescopic pole 420 can expand and retract out of and into the housing 110, and such telescopic poles and movements thereof are well known to one of ordinary skill in the art.

A first motor 520*a* is operatively connected to the first telescopic pole 410 and/or second telescopic pole 420 and functions to cause the first telescopic pole 410 and second telescopic pole 420 to expand out of the housing 110 or retract into the housing 110. As the telescopic poles expand out of the housing 110, the door 120 is pushed to the open position and the canvas 210 is expanded out of the housing 110 and covers the clothesline (see FIG. 4, FIG. 6).

Figure 4:
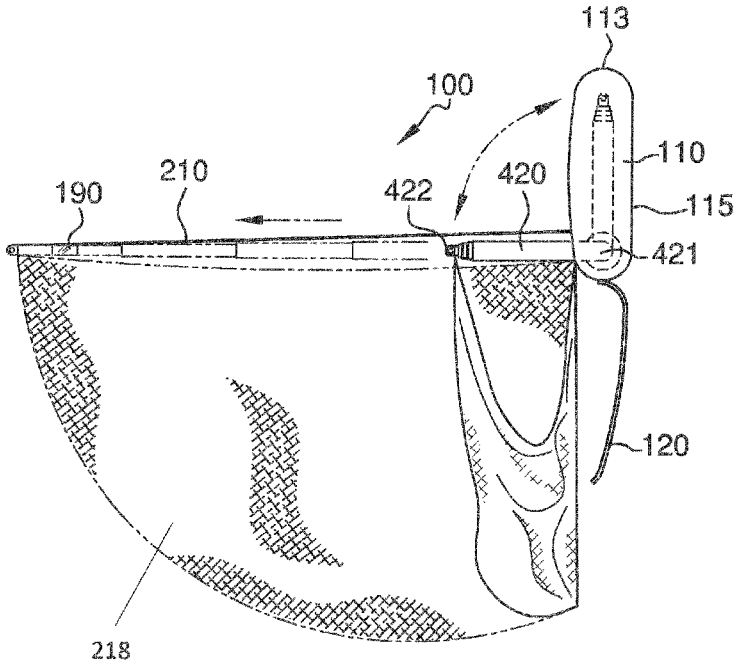
FIG. 4 is a side view of the clothesline cover apparatus of the present invention in an extended position.
Figure 5:
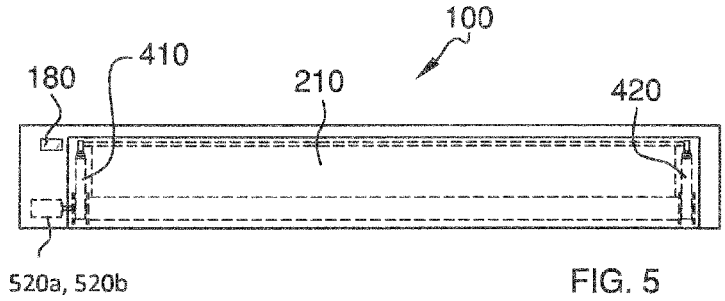
FIG. 5 is a front view and internal view of the clothesline cover apparatus of the present invention in a stored position.

As shown in FIG. 4, the canvas 210 may comprise side coverings 218, which function to cover the sides (e.g., sides of the clothes under the canvas 210). Generally, the side coverings 218 are constructed from a breathable material. The side coverings 218 may be particularly useful during windy conditions as rain may be blown sideways onto the clothing.

In some embodiments, the first end 411 of the first telescopic pole 410 and the first end 421 of the second telescopic pole 420 are pivotally attached in the housing 110. The first telescopic pole 410 and second telescopic pole 420 may pivot between a down position and an up position (see FIG. 4). For example, in the down position, the telescopic poles are in horizontal orientation with respect to the ground surface. In the down position, the telescopic poles may be positioned to expand out of the housing 110 to expand the canvas 210 and cover the clothesline. In the up position, the telescopic poles are in the vertical orientation with respect to the ground surface. The up position may be advantageous for storage purposes, for example the up position may provide a more compact configuration of the telescopic poles inside the housing 110.

In some embodiments, the first telescopic pole 410 and/or second telescopic pole 420 are operatively connected to a second motor 520*b*, which functions to pivot the telescopic poles 410, 420. In some embodiments, the first motor 520*a* functions to also pivot the telescopic poles 410, 420.

In some embodiments, the clothesline cover apparatus 100 further comprises a control switch 360. The control switch 360 may be operatively connected to the first motor 520*a* and/or second motor 520*b*. The control switch 360 may be used to turn the apparatus 100 (e.g., first motor, second motor) on and off. For example, the control switch 360 may allow a user to turn the apparatus 100 off such that the apparatus 100 does not operate when someone is in close range.

The clothesline cover apparatus 100 further comprises a first sensor 180 for detecting the presence and absence of rain. Such sensors are well known to one of ordinary skill in the art. In some embodiments, the first sensor 180 is disposed on the housing 110 near the top 113. The first sensor 180 is not limited to a position near the top 113 of the housing 110.

In some embodiments, the clothesline cover apparatus 100 further comprises a second sensor 190 for detecting the presence and absence of rain. In some embodiments, the second sensor 190 is disposed near the second end 412 of the first telescopic pole 410 and/or the second end 422 of the second telescopic pole 420. The second sensor 190 is not limited to a position near the second ends 214, 422 of the telescopic poles 410, 420.

The clothesline cover apparatus 100 further comprises a microprocessor operatively connected to the first motor 520 (and/or second motor 520*b*) and operatively connected to the first sensor 180 and/or the second sensor 190. The microprocessor is configured to receive a first rain input from the first sensor 180 when the first sensor 180 detects rain or from the second sensor 190 when the second sensor detects rain 190. Upon receipt of the first rain input signal, the microprocessor generates a first extension output command to the first motor 520*a* to cause the first motor 520 to expand the first telescopic pole 410 and second telescopic pole 420 out of the housing 110 to expand the canvas 210 over the clothesline. In some embodiments, the first extension output command may also cause the first motor 520*a* to pivot the telescopic poles to the down position. In some embodiments, upon receipt of the first rain input signal, the microprocessor generates a first extension output command to the first motor 520*a* (as above) and a first pivot output command to the second motor 520*b* to cause the second motor 520*b* to pivot the telescopic poles 410, 420.

In some embodiments, the microprocessor is configured to receive a second rain input from the first sensor 180 when the first sensor 180 detects the absence of rain or from the second sensor 190 when the second sensor 190 detects the absence of rain. Upon receipt of the second rain input signal, the microprocessor generates a second retraction output command to the first motor 520*a* to cause the first motor 520*a* to retract the first telescopic pole 410 and second telescopic pole 420 (and canvas 210) back into the housing 110. The second retraction output command may cause the first motor 520*a* to pivot the telescopic poles to the up position. As the telescopic poles are retracted into the housing 110, the door 120 may move (e.g., fall back into place) to the closed position. In some embodiments, upon receipt of the second rain input signal, the microprocessor generates a second retraction output command to the first motor 520*a* (as above) and a second pivot output command to the second motor 520*b* to cause the second motor 520*b* to pivot the telescopic poles 410, 420 to the up position.

In some embodiments, the motors 520 (e.g., first motor, second motor) and/or microprocessor are operatively connected to a power source. In some embodiments, the power source is a battery.

In some embodiments, the clothesline cover apparatus 100 further comprises a remote control. In some embodiments, the remote control is operatively connected to the microprocessor (e.g., via receives, transmitters, etc.) Receivers and transmitter devices are well known to one of ordinary skill in the art. In some embodiments, the remote control is programmed to turn on and off the apparatus 100 of the present invention.

The clothesline cover apparatus 100 of the present invention is not limited to use with a clothesline and/or drying rack. In some embodiments, the clothesline cover apparatus 100 is for covering a patio, a garden area, the like, or a combination thereof.

The clothesline cover apparatus 100 of the present invention may be constructed from a variety of materials. In some embodiments, the clothesline cover apparatus 100 is constructed from a material comprising a fabric, a plastic, a rubber, a metal, the like, or a combination thereof.

As used herein, the term "about" refers to plus or minus 10% of the referenced number. For example, an embodiment wherein the canvas 210 is about 10 feet long includes a canvas 210 that is between 9 and 11 feet long.

The clothesline cover apparatus 100 may be constructed in a variety of sizes. In some embodiments, the water-resistant canvas 210 is large enough to cover the clothesline.

In some embodiments, the housing 110 is between about 3 to 5 feet in length as measured from the first side 111 to the second side 112. In some embodiments, the housing 110 is between about 5 to 8 feet in length as measured from the first side 111 to the second side 112. In some embodiments, the housing 110 is between about 8 to 10 feet in length as measured from the first side 111 to the second side 112.

In some embodiments, the housing 110 is between about 0.5 to 1 feet in height as measured from the top 113 to the bottom 114. In some embodiments, the housing 110 is between about 1 to 2 feet in height as measured from the top 113 to the bottom 114. In some embodiments, the housing 110 is between about 2 to 4 feet in height as measured from the top 113 to the bottom 114.

In some embodiments, the housing 110 is between about 3 to 6 inches in width as measured from the front to the back surface 115. In some embodiments, the housing 110 is between about 6 to 12 inches in width as measured from the front to the back surface 115. In some embodiments, the housing 110 is between about 12 to 18 inches in width as measured from the front to the back surface 115.

In some embodiments, the canvas 210 is between about 2 to 4 feet in width as measured from the first side edge 211 to the second side edge 212. In some embodiments, the canvas 210 is between about 4 to 6 feet in width as measured from the first side edge 211 to the second side edge 212. In some embodiments, the canvas 210 is between about 6 to 10 feet in width as measured from the first side edge 211 to the second side edge 212.

In some embodiments, the canvas 210 is between about 2 to 4 feet in length as measured from the front edge 213 to the back edge. In some embodiments, the canvas 210 is between about 4 to 8 feet in length as measured from the front edge 213 to the back edge. In some embodiments, the canvas 210 is between about 8 to 12 feet in length as measured from the front edge 213 to the back edge.

Example 1

Use of the Clothesline Cover Apparatus

The following example describes the use of the clothesline cover apparatus 100 of the present invention. A user attaches the clothesline cover apparatus 100 on a wall in his backyard directly over his drying rack. Next, the user hangs his wet clothes to dry on the drying rack. Rain begins to fall a few hours later, and the first sensor 180 on the housing 110 of the clothesline cover apparatus 100 detects the rain. The microprocessor receives input from the first sensor 180 that there is rain and generates the output command to activate the motor, which expands the telescopic poles and canvas 210 outwardly over the drying rack. When the rain stops, the first sensor 180 or second sensor 190 detects the absence of rain, and the microprocessor generates the output command to the motor (s) 520 to retract the telescopic poles and canvas 210 back into the housing 110.

The following the disclosures of the following U.S. patents are incorporated in their entirety by reference herein: U.S.

Pat. No. 3,096,884; U.S. Pat. No. 7,000,788 B2; U.S. Pat. No. 5,591,907; U.S. Pat. No. 6,484,069 B2; U.S. Pat. No. 5,016,762.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A clothesline cover apparatus for covering a clothesline, said apparatus comprising:

(a) a housing with a door pivotally disposed in a front area of the housing via a hinge, the door can move between at least an open position and a closed position;

(b) a first telescopic pole and a second telescopic pole, both poles having a first end and a second end, the first ends of both poles are attached in an inner cavity of the housing, both poles can be expanded out of the housing together and retracted into the housing together via the door;

(c) a water-resistant canvas stored in the inner cavity of the housing, wherein a first side of the canvas is attached to at least a portion of the first telescopic pole and a second side of the canvas is attached to at least a portion of the second telescopic pole, the canvas comprises side coverings;

(d) a first motor operatively connected to the first telescopic pole or the second telescopic pole, the motor functions to expand the telescopic poles out of the housing or retract the telescopic poles into the housing;

(e) a first sensor for detecting the presence of rain and the absence of rain, the first sensor is disposed on the housing near a top area of the housing; and (f) a microprocessor operatively connected to the first sensor and to the motor, the microprocessor is configured to:

(i) receive a first rain input from the first sensor when the first sensor detects rain and subsequently generate a first extension output command to the motor to cause the motor to expand the telescopic poles out of the housing; and (ii) receive a second rain input signal from the first sensor when the first sensor does not detect rain and subsequently generate a second retraction output command to the first motor to cause the motor to retract both telescopic poles back into the housing;

wherein when both the first telescopic pole and the second telescopic pole are expanded from the housing the canvas is expanded outwardly to cover the clothesline.

2. The apparatus of claim 1, wherein the first end of the first telescopic pole and the first end of the second telescopic pole are both pivotally attached in the housing, both telescopic poles can pivot between a down position such that both poles are oriented generally horizontally with respect to a ground surface and an up position such that both poles are oriented generally vertically inside the housing for storage purposes.

3. The apparatus of claim 1, wherein a plurality of mounting holes is disposed in a back surface of the housing for allowing the housing to be attached to a wall or other surface.

4. The apparatus of claim 1 further comprising a second sensor for detecting the presence of rain and the absence of rain, the second sensor being disposed near a second end of either the first telescopic pole or the second telescopic pole, the second sensor is operatively connected to the microprocessor.

* * * * *